United States Patent [19]

Dauphin et al.

[11] Patent Number: 4,753,352

[45] Date of Patent: Jun. 28, 1988

[54] IMPERVIOUS PACKAGING IN THE FORM OF A CARD HAVING COMPARTMENTS AND PERMITTING GASEOUS EXCHANGE BETWEEN THE COMPARTMENTS

[75] Inventors: Jacques Dauphin, Orleans; Alain Cuine, Chely, both of France

[73] Assignee: ADIR et Compagnie, Neuilly-sur-Seine, France

[21] Appl. No.: 866,796

[22] Filed: May 23, 1986

[30] Foreign Application Priority Data

Jan. 22, 1986 [FR] France ..... 86 00837

[51] Int. Cl.[4] ..... B65D 83/04

[52] U.S. Cl. ..... 206/538; 206/204; 206/528; 206/524.4

[58] Field of Search ..... 206/204, 205, 213.1, 206/484, 461, 471, 524.4, 528, 531, 534.1, 538, 828, 524.8

[56] References Cited

U.S. PATENT DOCUMENTS

| | | | |
|---|---|---|---|
| 3,343,897 | 9/1967 | Keller | 206/204 |
| 3,567,085 | 3/1971 | Flores | 206/204 |
| 3,894,896 | 7/1975 | Watanabe | 206/538 |
| 4,040,515 | 8/1977 | Hessel et al. | 206/205 |
| 4,441,609 | 4/1984 | Crowley | 206/204 |
| 4,444,316 | 4/1984 | Casberg | 206/524.4 |
| 4,450,959 | 5/1984 | Sommer | 206/538 |

FOREIGN PATENT DOCUMENTS

| | | | |
|---|---|---|---|
| 640751 | 1/1964 | Belgium | 206/204 |
| 1182739 | 1/1959 | France | 206/204 |

*Primary Examiner*—David T. Fidei
*Attorney, Agent, or Firm*—Gordon W. Hueschen

[57] ABSTRACT

New impervious single packaging in the form of a card having compartments and permitting gaseous exchange between the compartments, of which one or more are designed to contain a gas absorber or generator and the others act as receptacles for the solid bodies to be stored; the said compartments being interconnected by small channels.

This safety packaging is particularly suited to use in the storage of solid pharmaceutical bodies (tablets, capsules or others).

12 Claims, 2 Drawing Sheets

IMPERVIOUS PACKAGING IN THE FORM OF A CARD HAVING COMPARTMENTS AND PERMITTING GASEOUS EXCHANGE BETWEEN THE COMPARTMENTS

The present invention relates to impervious packaging in the form of a card having compartments and permitting gaseous exchange between the compartments.

This packaging, which can be used for any product which for its preservation requires impervious packing, is particularly well suited to the pharmaceutical industry.

The packaging forming the subject of the present invention is distinguished from already existing packaging for pharmaceutical bodies and, by comparison with these, offers advantages which are of particular interest.

In fact, hitherto packagings permitting gaseous exchange have either been sealed bottles with a gas absorber or generator, or cards with compartments around which cards there is provided a second impervious packaging containing a gas absorber or generator. The bottle does not constitute a safety packaging, as access to the entire contents is facilitated. The packaged card with compartments requires the use of two successive packaging operations. The novel packaging proposed is a single packaging making it possible for each pharmaceutical body to be separate whilst at the same time permitting gaseous exchange. It combines stability of preservation of the medicaments, hitherto guaranteed by the use of bottles with an absorber, with safety of use, offered by the conventional blister packs, and for this reason is of particular interest.

IN THE DRAWINGS

Reference is now made to the accompanying drawings, wherein.

The present invention relates in particular to a gas-impermeable packaging provided in the form of a card comprising in its upper part an impervious heat-sealable film and in its lower part an impervious film in which the compartments, interconnected by small channels, are formed by embossing or thermoforming, or by both of these techniques.

The compartments of one and the same card may be different sizes. One or more compartments contain a gas generator or absorber, and the other compartments contain separate solid pharmaceutical bodies (tablets, capsules, lyocs . . . ).

The gaseous exchange inside the card is via small channels connecting the compartments with one another. Their size may vary depending on the gaseous exchange desired.

The materials constituting a barrier to gases used for the manufacture of the card are:

heat-sealable aluminium composite materials: polyethylene-aluminium-polyethylene, thermoformable plastics materials: polyvinyl chloride (PVC)+polyvinylidene chloride; polyvinyl chloride+polyethylene+polyvinylidene chloride.

It is also possible to use other "barrier" materials such as, for example, polypropylene or coextruded materials based on polyvinyl alcohol resins.

The products that absorb or generate gas are:

molecular sieves, on their own or containing nitrogen silica gels potassium carbonates magnesium oxide reactivated clays.

The following Examples, which are in no way limiting, illustrate the present invention.

EXAMPLE 1

Card with compartments for packaging tablets based on a product that is sensitive to moisture Example 1.A (a) formula of the tablet:

| | |
|---|---|
| 2-(N—dicyclopropylmethyl)aminooxazoline phosphate | 1 mg |
| lactose | 70 mg |
| microcrystalline cellulose | 28 mg |
| magnesium stearate | 1 mg |

Figure 1:
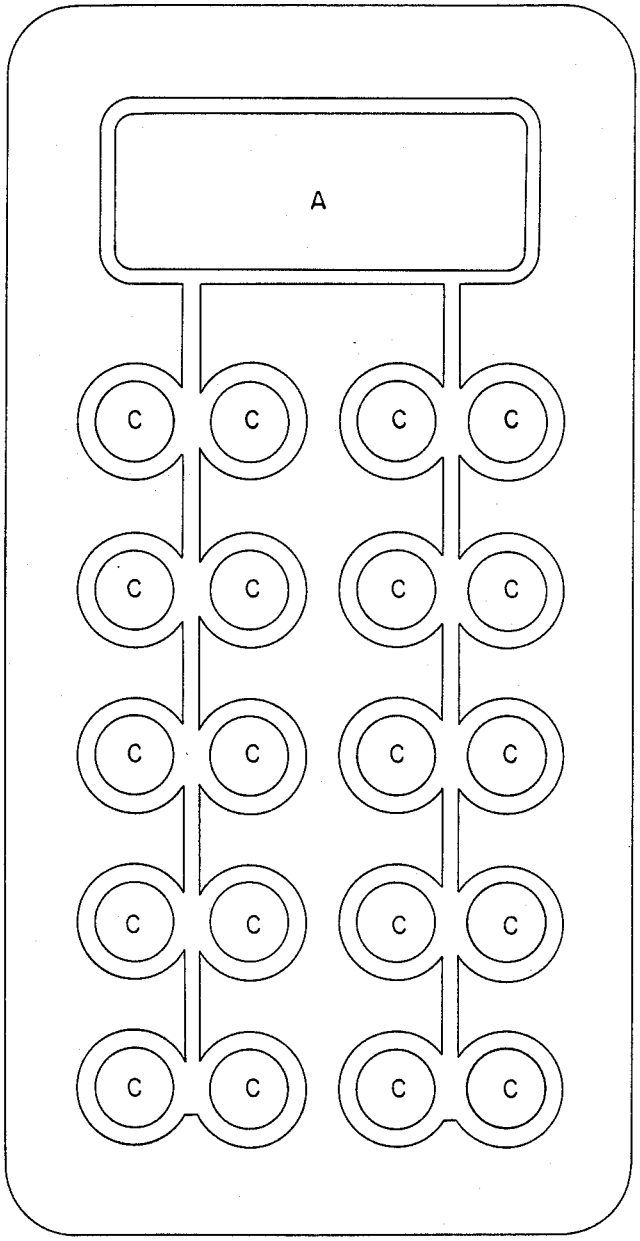
FIG. 1 is a face or top plan view of one form of packaging according to the present invention.

(b) absorbent product:

silica gel (c) type of card with compartments:

It corresponds to the attached FIG. 1/2. The lower face is formed by a polyethylene-aluminium-polyethylene composite material; the upper face is formed by a heat-sealable aluminium foil.

Such a card comprises in its upper part a compartment (A), a receptacle for the absorbent product, to which there is connected a double row of compartments (C) which are to contain the tablets.

In each of these rows, the compartments (C) are grouped in pairs on both sides of a small channel connecting them to one another and to the compartment (A) containing the absorbent product.

Such a card contains sufficient medication for 10 days' treatment at the rate of 2 tablets per day.

(d) Advantages:

The method of packaging described above ensures stability of the tablets for storage of a long duration, at the manufacturer's or the wholesaler's, for example.

In fact, depending on the method of packaging, the quality of the tablets, as a percentage in relation to the initial quality after a period of three months at 37° C. and 75% relative humidity, is as follows:

| Mode of packaging | Quality of the tablets as a percentage |
|---|---|
| Blister PVC | 60.1% |
| Blister PVC overwrapped with clarylene ® | 97.8% |
| Pill container with absorber | 98.2% |
| Card with compartments of Example 1.A | 98.2% |

Thus, the card with compartments shown diagrammatically in the attached FIG. 1/2 provides the packaged tablets with a stability that is greater than that provided by conventional blister packs even when overwrapped. It offers the same guarantee of stability to the tablets as the pill container with absorber, but by comparison with the latter has the advantage of being in a form permitting sequential treatment, which is especially advantageous in the treatment of patients at high risk.

Example 1.B

Similar results were obtained using the same type of card with compartments and the same absorbant product as in Example 1.A, with tablets, the unit formula of which is:

| | |
|---|---|
| 2-(N—dicyclopropylmethyl)aminooxazoline phosphate (corresponding to 0.001 g of base) | 0.001544 g |
| sodic carboxymethyl starch | 0.0045 g |
| microcrystalline cellulose | 0.03367 g |
| white wax | q.s. |
| lactose | 0.047 g |
| paraffin | 0.00015 g |
| colloidal silica | 0.00023 g |
| magnesium stearate | 0.0009 g |
| talc | 0.002 g |
| for one tablet at 0.090 g | |

Depending on the method of packaging, the quality of the tablets, as a percentage in relation to the initial quality after a period of three months at 37° C. and 75% relative humidity, is as follows

| Mode of packaging | Quality of the tablets as a percentage |
|---|---|
| Blister PVC | 65.3% |
| Blister PVC overwrapped with clarylene ® | 97.1% |
| Pill container with absorber | 98.1% |
| Card with compartments of Example 1.B | 98.9% |

The above comparative results enable to draw the same conclusion as the one given in Example 1.A.

EXAMPLE 2

Card with compartments for packaging effervescent tablets (a) Formula of the tablet:

| | |
|---|---|
| ascorbic acid | 100 mg |
| inositocalcium | 20 mg |
| tartaric acid | 100 mg |
| sodium bicarbonate | 100 mg |
| sodium chloride | 3 mg |
| sodium cyclamate | 9 mg |
| dry extract of orange | 12.7 mg |
| Orange yellow S | 0.3 mg |
| polyoxyethylene glycol 6000 | 5 mg |
| saccharose | 100 mg |

(b) Absorbent product:

Molecular sieve.

Figure 2:
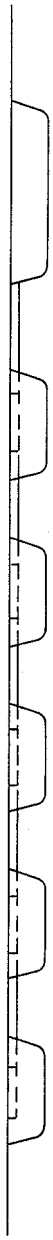
FIG. 2 is a profile or side view thereof.
Figure 3:
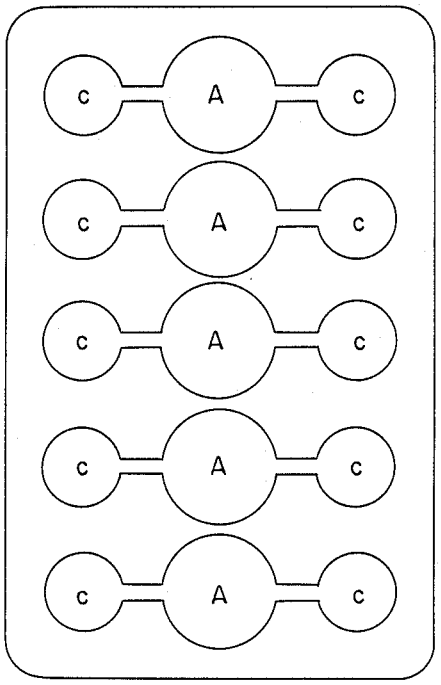
FIG. 3 is a face or top plan view of another embodiment of packaging according to the present invention.
Figure 4:
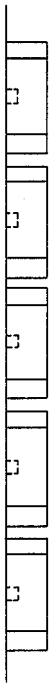
FIG. 4 is a profile or side view thereof.

(c) Type of card with compartments:

It corresponds to the diagram shown in the attached FIG. 2/2. The lower face is formed by a composite material comprising polyvinyl chloride+polyethylene+polyvinylidene chloride; the upper face is formed by a heat-sealable aluminium foil.

Such a card comprises five groups of compartments each comprising a central compartment (A), which is to contain the absorbent product, connected on both sides by a small channel to two compartments which are receptacles for the tablets. Such a card contains sufficient medication for a 5 day treatment at a dose of 2 tablets per day.

(d) Advantages:

Investigation of the effervesence of the tablets after storage for 3 months at 37° C. and 75% relative humidity was carried out for different types of packaging. The results are listed in the table below:

| Mode of packaging | Effervescence |
|---|---|
| Blister PVC | absence of effervescence |
| Pill container with absorber | normal effervescence |
| Card with compartments of Example 2 | normal effervescence |

The card with compartments shown diagrammatically in the attached FIG. 2/2, apart from providing individual packaging of each pill, ensures perfect preservation of the said tablets during storage, since the latter retain their original effervesence.

We claim:

1. Impervious single packaging in the form of a card having compartments and permitting gaseous exchange between the compartments, suitable for use for containment of separate solid pharmaceutical bodies, characterized in that said packaging comprises a card comprising, on its one side, a heat-sealable impervious film and, on its other side, an impervious film in which compartments, connected by small intercommunicating channels, have been formed, and in that at least one of said compartments designated (A) is adapted to contain a gas absorber or generator, whereas a plurality of other compartments designated (C) are adapted to act as receptacles for solid bodies to be stored therein, wherein said compartment (A) adapted to contain said gas absorber or generator is connected with said plurality of other compartments (C) by said small intercommunicating channels, and wherein to each compartment (A) there is connected at least one row of compartments (C) which compartments (C) are also connected to each other by said small intercommunicating channels.

2. Packaging according to claim 1, characterised in that the material used for the manufacture of the card is selected from heat-sealable aluminum composite materials, thermoformable plastics materials, polypropylene, and co-extruded materials based on polyvinyl alcohol resins.

3. Packaging according to claim 2, characterised in that the absorbent product or the gas generator used is selected from the group consisting of: molecular sieves, as such or containing nitrogen, silica gel, potassium carbonate, magnesium oxide, and reactivated clay.

4. Impervious single packaging in the form of a card having compartments and permitting gaseous exchange between the compartments, suitable for use for containment of separate solid pharmaceutical bodies, characterized in that said packaging is particularly adapted to contain tablets based on a product which is sensitive to moisture, and further characterised in that said packaging comprises a card comprising on its one side a heat-sealable impervious film and, on its other side, an impervious film in which compartments, connected by small intercommunicating channels, have been formed, including a compartment (A), which is a receptacle adapted to receive an absorbent product, to which compartment (A) there is connected a double row of compartments (C) which are adapted to contain tablets, in each of which rows the compartments (C) are grouped in pairs on the sides of a small channel connecting them to one another and also to the compartment (A) containing the absorbent product.

5. Packaging according to claim 4 characterised in that the lower face of the card with compartments is formed by a polyethylene-aluminium-polyethylene composite material, and the upper face by a heat-sealable aluminium foil.

6. Packaging according to claim 5 characterised in that the absorbent product is silica gel.

7. Packaging according to claim 6 characterised in that the packaged tablets contain 2-(N-dicyclopropylmethyl)aminooxazoline phosphate as active ingredient.

8. Packaging according to claim 7 characterised in that the packaged tablets each contain 0.001544 g of 2-(N-dicyclopropylmethyl)aminooxazoline phosphate corresponding to 0.001 g of base.

9. Impervious single packaging in the form of a card having compartments and permitting gaseous exchange between the compartments, suitable for use for containment of separate solid pharmaceutical bodies, characterized in that said packaging is particularly adapted for effervescent tablets, characterised in that it is comprises a card comprising, on its one side, a heat-sealable impervious film and, on its other side, an impervious film in which compartments, connected by small intercommunicating channels, have been formed, said compartments comprising a plurality of groups of compartments, each group comprising a central compartment (A), which central compartment is adapted to contain an absorbent product, said central compartment being connected on each side by a small intercommunicating channel to at least one compartment (C) which is adapted to be a receptacle for a tablet.

10. Packaging according to claim 9 characterised in that the lower face of the card with compartments is formed by a polyvinyl chloride+polyethylene+-polyvinylidene chloride composite material, and the upper face by a heat-sealable aluminum foil.

11. Packaging according to claim 10 characterised in that the absorbent product is a molecular sieve.

12. Packaging according to claim 11 characterised in that the packaged tablets contain ascorbic acid as active ingredient.

* * * * *